US006619632B2

(12) United States Patent
Suzuki

(10) Patent No.: US 6,619,632 B2
(45) Date of Patent: Sep. 16, 2003

(54) CHOKE VALVE DEVICE IN CARBURETOR

(75) Inventor: Takashi Suzuki, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/202,640

(22) Filed: Jul. 25, 2002

(65) Prior Publication Data

US 2003/0025218 A1 Feb. 6, 2003

(30) Foreign Application Priority Data

Aug. 3, 2001 (JP) ..... 2001-236803

(51) Int. Cl.[7] ..... F02M 1/14
(52) U.S. Cl. ..... 261/64.4; 261/64.6
(58) Field of Search ..... 261/64.4, 64.6, 261/64.3, 64.1, 61, DIG. 64

(56) References Cited

U.S. PATENT DOCUMENTS 1,909,777 A * 5/1933 Mallory ..... 261/52
1,957,289 A * 5/1934 Purpura ..... 123/588
1,995,452 A * 3/1935 Harbison ..... 261/39.1
2,162,056 A * 6/1939 Bracke ..... 261/34.2
2,695,033 A * 11/1954 Campbell ..... 137/481
3,802,671 A * 4/1974 Klutho ..... 261/34.2
4,005,690 A * 2/1977 Hirosawa et al. ..... 261/39.6
4,052,488 A * 10/1977 Schoeman ..... 261/18.3
4,202,302 A * 5/1980 Tamura ..... 261/39.3
4,439,377 A * 3/1984 Nartowski ..... 261/52
4,672,929 A * 6/1987 Wissmann et al. ..... 123/179.18
4,951,926 A * 8/1990 O'Shea et al. ..... 261/64.4
5,511,519 A * 4/1996 Watson et al. ..... 123/179.18

FOREIGN PATENT DOCUMENTS

JP 61-25563 2/1986

* cited by examiner

*Primary Examiner*—Richard L. Chiesa
(74) *Attorney, Agent, or Firm*—Armstrong, Westerman & Hattori, LLP

(57) ABSTRACT

A choke valve device in a carburetor including an opening spring for biasing a choke valve in a fully opening direction, a negative pressure operating chamber provided in a carburetor body to communicate with an intake passage at a location downstream from the choke valve, a locking piston which has a pressure-receiving face facing the negative pressure operating chamber and which is adapted to be advanced and retracted between a locked position (L) and a unlocked position (U), a locking spring for biasing the locking piston toward the locked position (L), and a locking recess which is provided in a choke lever secured to a valve stem so that the locking recess engages with the locking piston advanced to the locked position (L) when the choke lever is moved to a fully closed position (C) of the choke valve. When an intake negative pressure equal to or greater than a predetermined value is introduced into the negative pressure operating chamber upon starting an engine, the locking piston is retracted to the unlocked position (U) and disengaged from the locking recess, so that the choke valve is fully opened automatically by a biasing force of the opening spring. Thus, the automatic opening of the choke valve can be carried out with a simple structure having a reduced number of parts.

2 Claims, 6 Drawing Sheets

CHOKE VALVE DEVICE IN CARBURETOR

BACKGROUND OF THE INVENTION

1. Field of the Invention

The present invention relates to a choke valve device in a carburetor including a carburetor body which has an intake passage and in which a valve stem of a choke valve for opening and closing the intake passage at a location upstream of the intake passage is rotatably carried, and particularly to an improvement in the choke valve device in the carburetor, which is designed so that a choke valve fully closed prior to the starting of an engine is fully opened automatically after the starting of an engine.

2. Description of the Related Art

Such a choke valve device in the carburetor is already known, as disclosed, for example, in Japanese Patent Utility Model Application Laid-open No.61-25563.

In the above-described choke valve device described in Japanese Patent Utility Model Application Laid-open No.61-25563, an operating member for opening a choke lever secured to a valve stem of a choke valve and a diaphragm device adapted to be operated by an intake negative pressure in an engine are connected to the choke lever, and when the engine is started with the choke valve fully closed by the operating member, the diaphragm device is operated by an intake negative pressure generated with the starting of the engine, and the choke valve is fully opened by an operating force of the diaphragm device.

In this conventional choke valve device, the number of parts is large and the diaphragm device is expensive, inevitably leading to an increase in cost is.

SUMMARY OF THE INVENTION

Accordingly, it is an object of the present invention to provide a choke valve device in a carburetor, wherein a choke valve can be opened automatically with a simple structure having a decreased number of parts.

To achieve the above object, according to a first aspect and feature of the present invention, there is provided a choke valve device in a carburetor including a carburetor body which has an intake passage and in which a valve stem of a choke valve for opening and closing the intake passage at a location upstream of the intake passage is rotatably carried, wherein the choke valve is biased in an opening direction by a spring. A negative pressure operating chamber is provided in the carburetor body to communicate with the intake passage at a location downstream from the choke valve; wherein a locking piston is mounted in the carburetor body with its pressure-receiving face facing the negative pressure operating chamber and is adapted to be advanced and retracted between a locked position and an unlocked position, the locking piston being biased toward the locked position by a locking spring. A choke lever secured to said valve stem is provided with a locking portion which restrains said choke lever at the fully closed position in such a manner that said locking portion engages with said locking piston advanced to said locked position by a biasing force of said locking spring, when said choke lever has been turned to a fully closed position of said choke valve. The locking piston is retracted to the unlocked position and disengaged from the locking portion when an intake negative pressure equal to or greater than a predetermined value is introduced into the negative pressure operating chamber upon starting the engine.

With the first feature, when the choke lever is moved to the fully closed position of the choke valve prior to the starting of the engine, the locking piston can be advanced to the locked position by the biasing force of the locking spring to come into engagement with the locking portion of the choke lever, thereby restraining the choke lever in the fully closed position.

The engine is started, and the intake negative pressure generated in the engine is transmitted to the intake passage and inhibited by the choke valve in the fully closed state from being released to the atmospheric air. That is, the intake negative pressure equal to or greater than the predetermined value is introduced into the negative pressure operating chamber, whereby the locking piston is pulled toward the unlocked position against the biasing force of the locking spring. Therefore, the locking piston is disengaged from the locking portion of the choke lever to release the choke lever, so that the choke lever biased by the spring in the fully opening direction is turned automatically to the fully opened position of the choke valve, thereby restoring the choke valve to the fully opened state.

Moreover, the choke valve device has a simple structure with a very small number of parts, as compared with the conventional choke valve device using the diaphragm device. Therefore, the choke valve device can be provided at a low cost.

According to a second aspect and feature of the present invention, in addition to the first feature, the choke lever has a sliding surface which slidably receives an outer end face of the locking piston and inhibits the advancing of the locking piston toward the locked position of the locking piston when the choke valve is in a position other than the fully closed position.

With the second feature, when the negative pressure introduced into the negative pressure operating chamber is decreased by opening the choke valve after the starting of the engine, the locking piston is about to be advanced again toward the locked position by the biasing force of the locking spring. However, the sliding surface of the choke lever already moved in the fully opened position of the choke valve receives the locking piston, and inhibits the advancing of the piston toward the locked position. Therefore, it is unnecessary to mount a member exclusive for preventing the slipping-off of the locking piston, so that the structure can be further simplified.

The locking portion corresponds to a locking recess 23 in an embodiment of the present invention which will be described below.

The above and other objects, features and advantages of the invention will become apparent from the following description of the preferred embodiment taken in conjunction with the accompanying drawings.

DESCRIPTION OF THE PREFERRED EMBODIMENT

The present invention will now be described by way of an embodiment with reference to the accompanying drawings.

Figure 1:
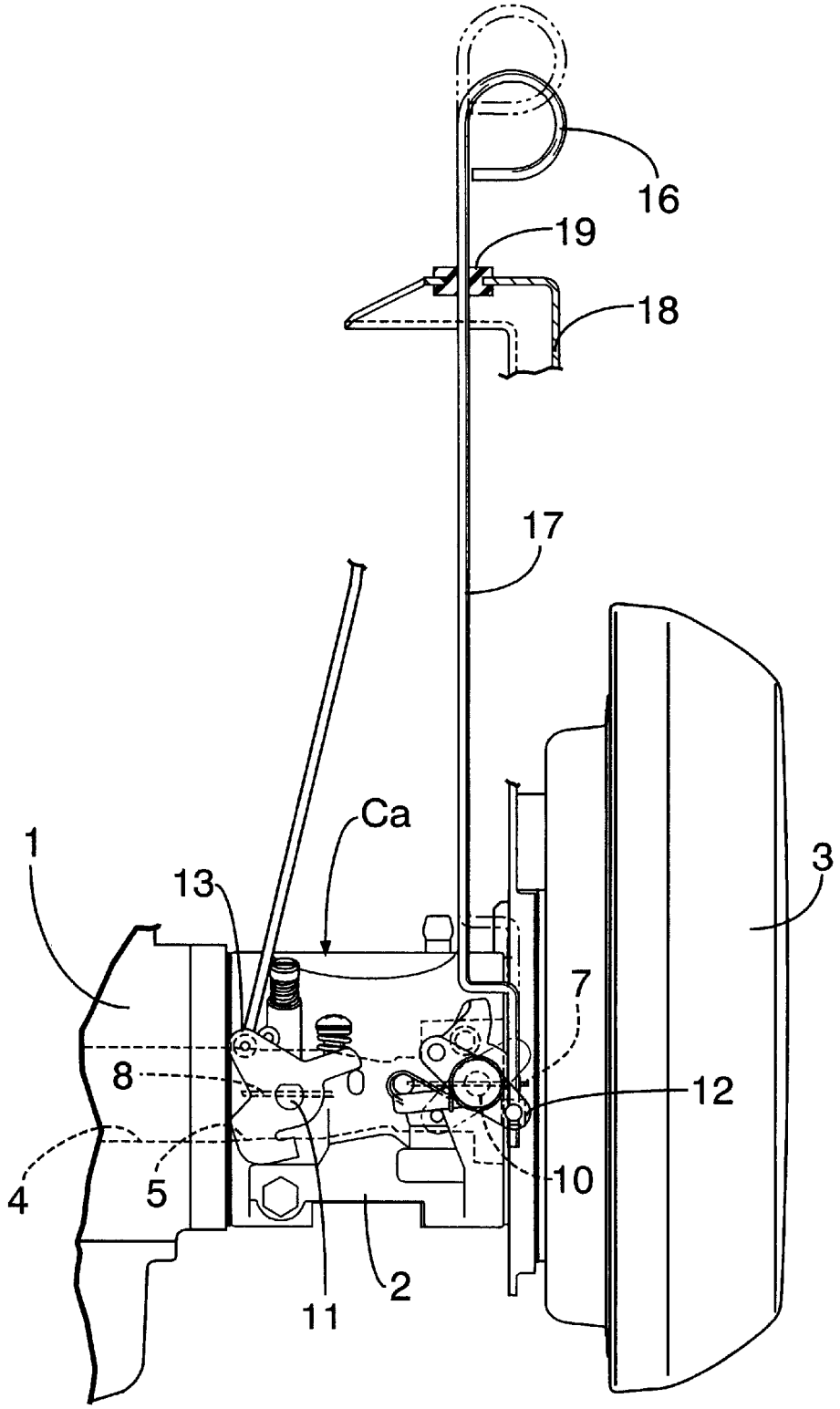
FIG. 1 is a plan view of an intake system of an engine provided with a carburetor according to the present invention.

Referring first to FIG. 1, a carburetor body 2 of a carburetor Ca is mounted to one side of a cylinder head 1 of an engine, and an air cleaner 3 is mounted at an end of an inlet in the carburetor body 2.

Figure 2:
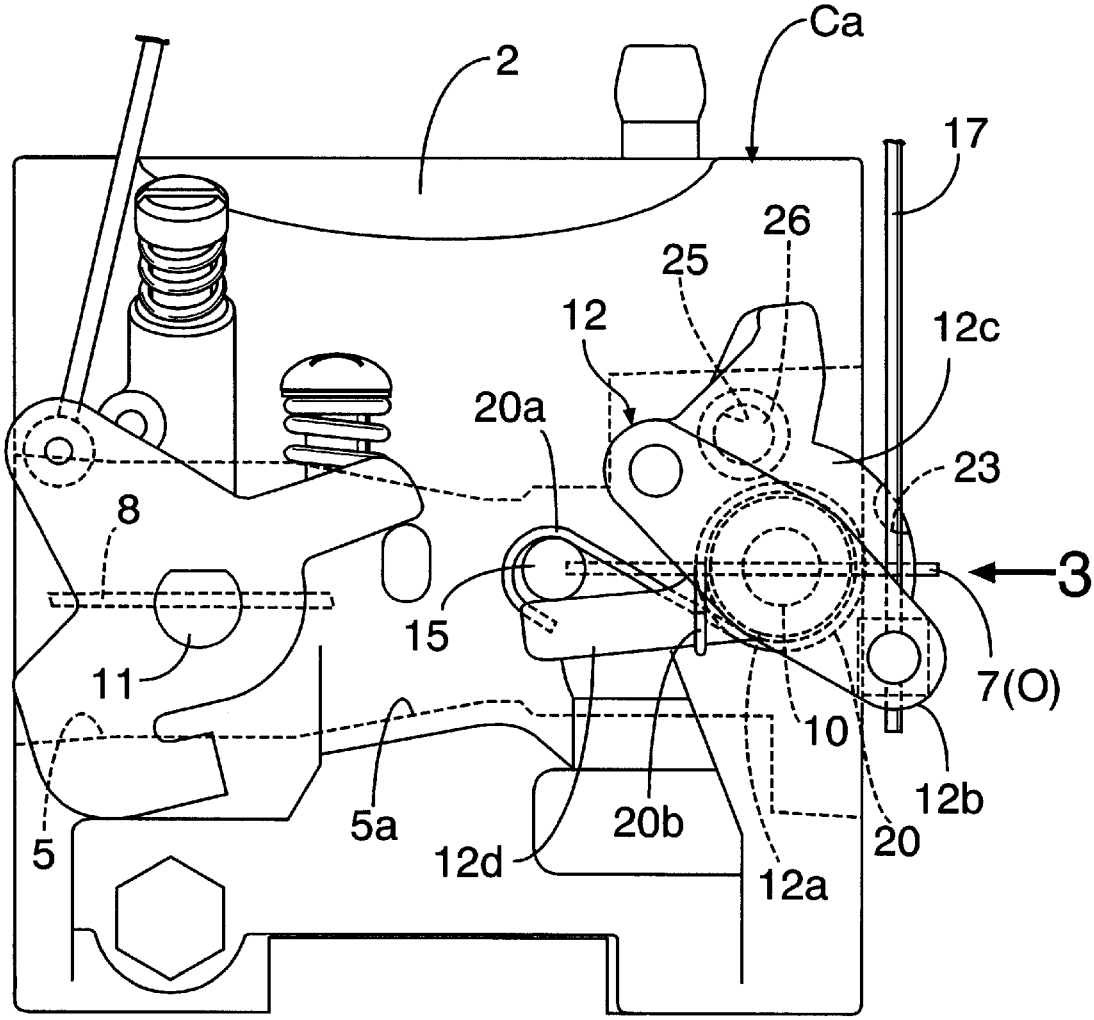
FIG. 2 is an enlarged plan view of the carburetor.
Figure 3:
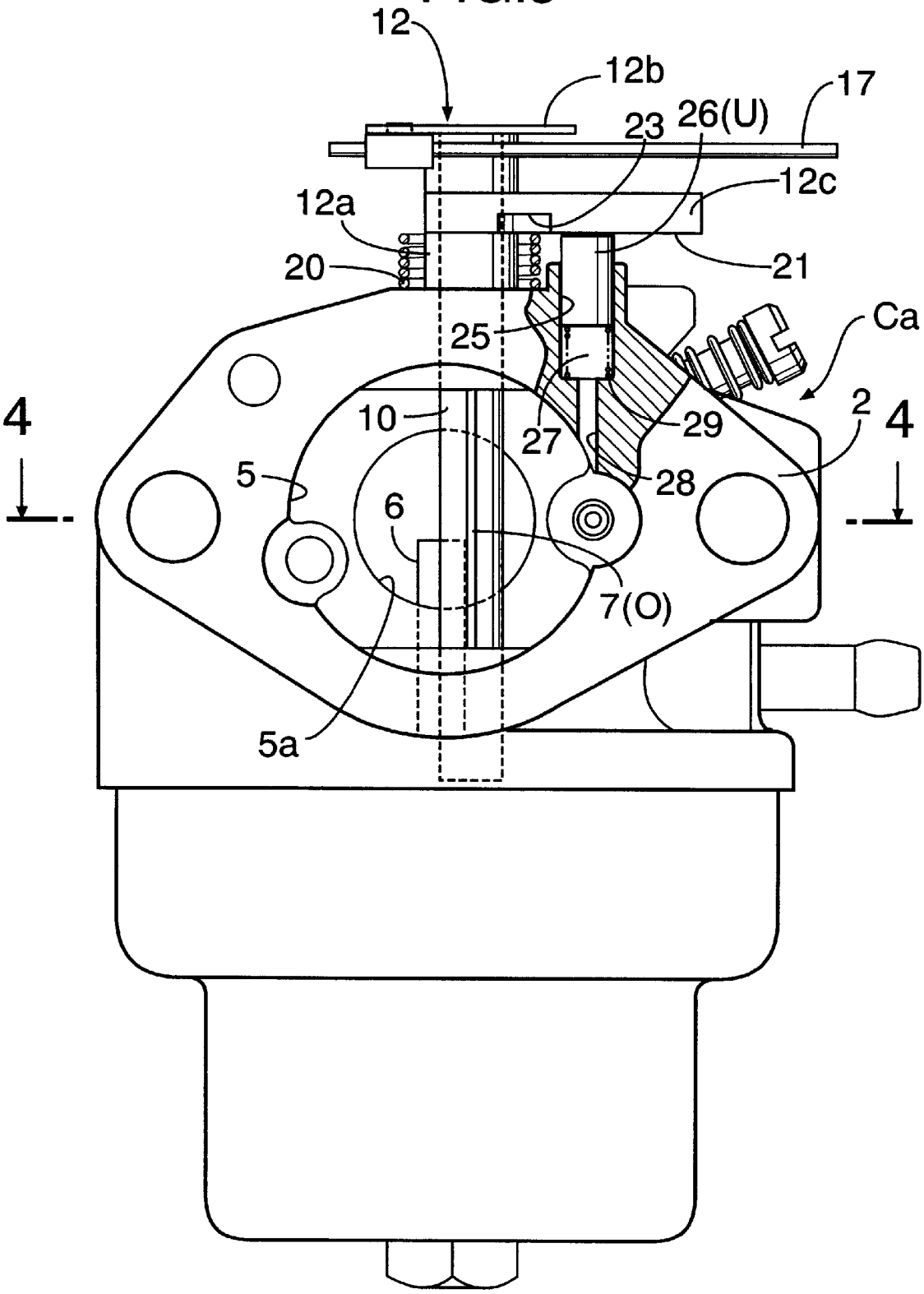
FIG. 3 is a view taken in a direction of an arrow 3 in FIG. 2.
Figure 4:
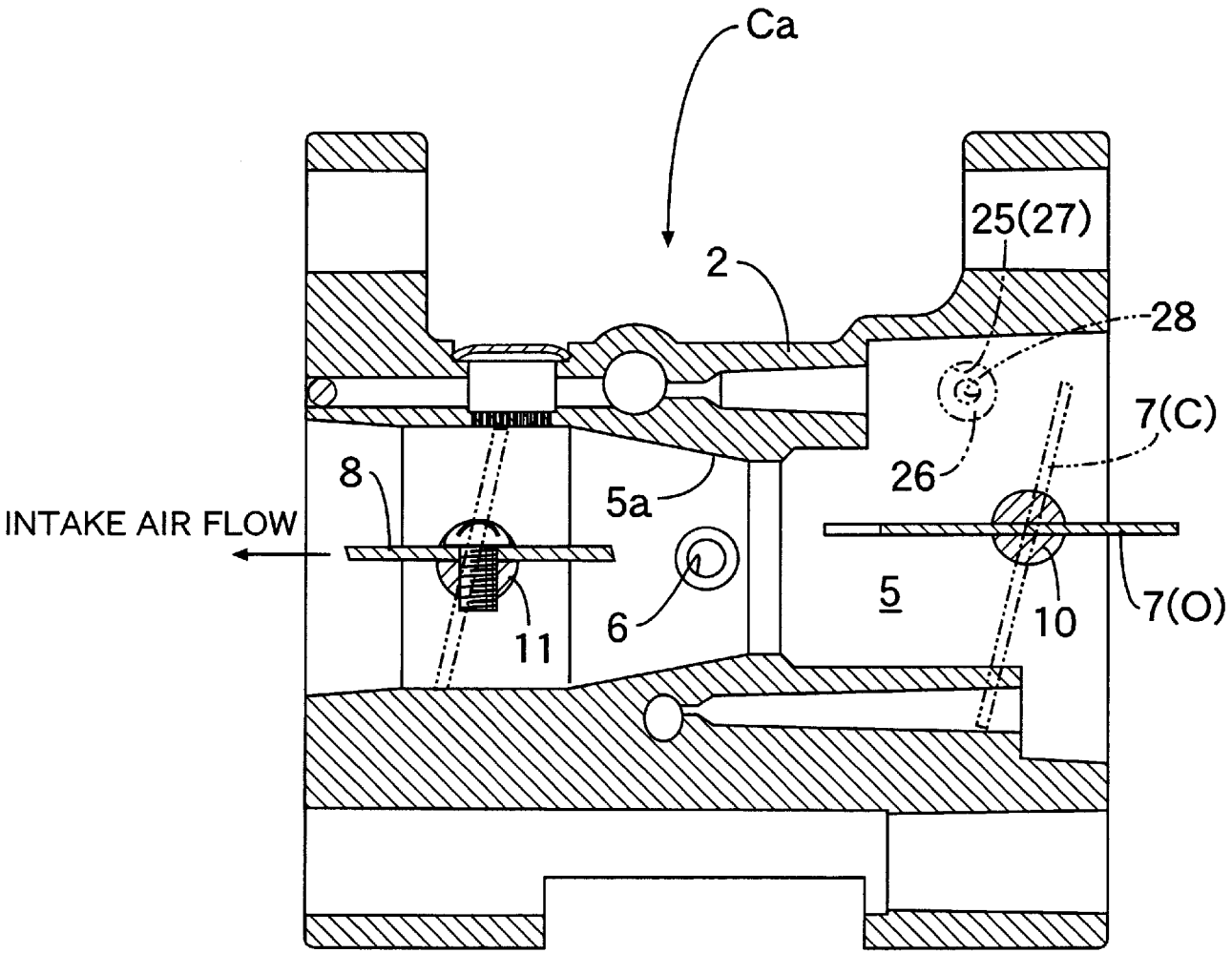
FIG. 4 is a sectional view taken along a line 4—4 in FIG. 3.

As shown in FIGS. 2 to 4, an intake passage 5 is defined in the carburetor body 2 to lead to an intake port 4 in the cylinder head 1. A main nozzle 6 opens into a venturi 5*a* at a central portion of the intake passage 5. A choke valve 7 and a throttle valve 8 are disposed at an upstream location and a downstream location respectively in the intake passage 5 with the main nozzle 6 interposed therebetween. Valve stems 10 and 11 of the choke valve 7 and the throttle valve 8 in parallel to each other are rotatably carried in the carburetor body 2. A choke lever 12 is secured to an outer end of the valve stem 10 of the choke valve 7 which protrudes above the carburetor body 2, and a throttle-lever 13 is secured to an outer end of the valve stem 11 of the throttle valve 8 which protrudes above the carburetor body 2. Therefore, the choke valve 7 and the throttle valve 8 can be opened and closed by operating the choke lever 12 and the throttle lever 13, respectively.

The choke lever 12 comprises a boss 12*a* fitted over an outer periphery of the valve stem 10, an operating arm 12*b* formed integrally at an upper end of the boss 12*a*, and a control collar 12*c* and a stopper arm 12*d* formed integrally at an intermediate portion of the boss 12*a*. The stopper arm 12*d* defines a fully opened position O of the choke valve 7 by abutting against a stationary stopper 15 of the carburetor body 2. A fully closed position C of the choke valve 7 is defined by the contact of a peripheral edge of the choke valve 7 with an inner peripheral surface of the intake passage 5.

A connecting rod 17 leading to an operating knob 16 (see FIG. 1) is connected to a tip end of the operating arm 12*b*. The intermediate portion of the connecting rod 17 is slidably carried on a bearing 19 mounted on an engine cover 18 (see FIG. 1). An opening spring 20, which is a torsion coil spring, is mounted around an outer periphery of the boss 12*a* below the control collar 12*c*, and has a stationary end 20*a* locked to a stationary stopper 15 of the carburetor body 2 and a movable end 20*b* locked to the stopper arm 12*d*. The choke lever 12 is constantly biased in a direction to open the choke valve 7 by the opening spring 20.

A locking recess 23 is defined in a lower surface 21 of the control collar 12*c* so that an upper end of a locking piston 26, which will be described below, can engage with the locking recess 23.

A cylinder bore 25 is made in the carburetor body 2 and opens toward the lower surface of the control collar 12*c*, and the locking piston 26 is slidably received in the cylinder bore 25. A negative pressure operating chamber 27 is defined between a lower end face of the piston 26 and a bottom surface of the cylinder bore 25. Therefore, a lower end face, i.e., a pressure-receiving face of the locking piston 26 faces the negative pressure operating chamber 27. The negative pressure operating chamber 27 communicates with the intake passage 5 at a location downstream from the choke valve 7 through a negative pressure introducing bore 28.

A locking spring 29 for biasing the locking piston 26 toward the control collar 12*c* is mounted under compression in the negative pressure operating chamber 27. The locking piston 26 is advanced and retracted by a biasing force of the locking spring 29 between a locked position L in which it is engaged with the locking recess 23 and an unlocked position U in which it is disengaged from the locking recess 23. The timing of the engagement between the locking piston 26 and the locking recess 23 is set at a point when the choke lever 12 reaches a fully closed position C of the choke valve 7.

A lower surface 21 of the control collar 12*c* is formed as a sliding surface adapted to slidably receive an upper end face of the locking piston 26 to retain the locking piston 26 at the unlocked position U when the choke lever 12 is moved to a position other than the fully closed position C of the choke valve 7 during stoppage of the operation of the engine.

An operating system for the throttle valve 8 is not different from a conventional usual system, and the description thereof is omitted.

The operation of the embodiment will be described below.

Figure 5:
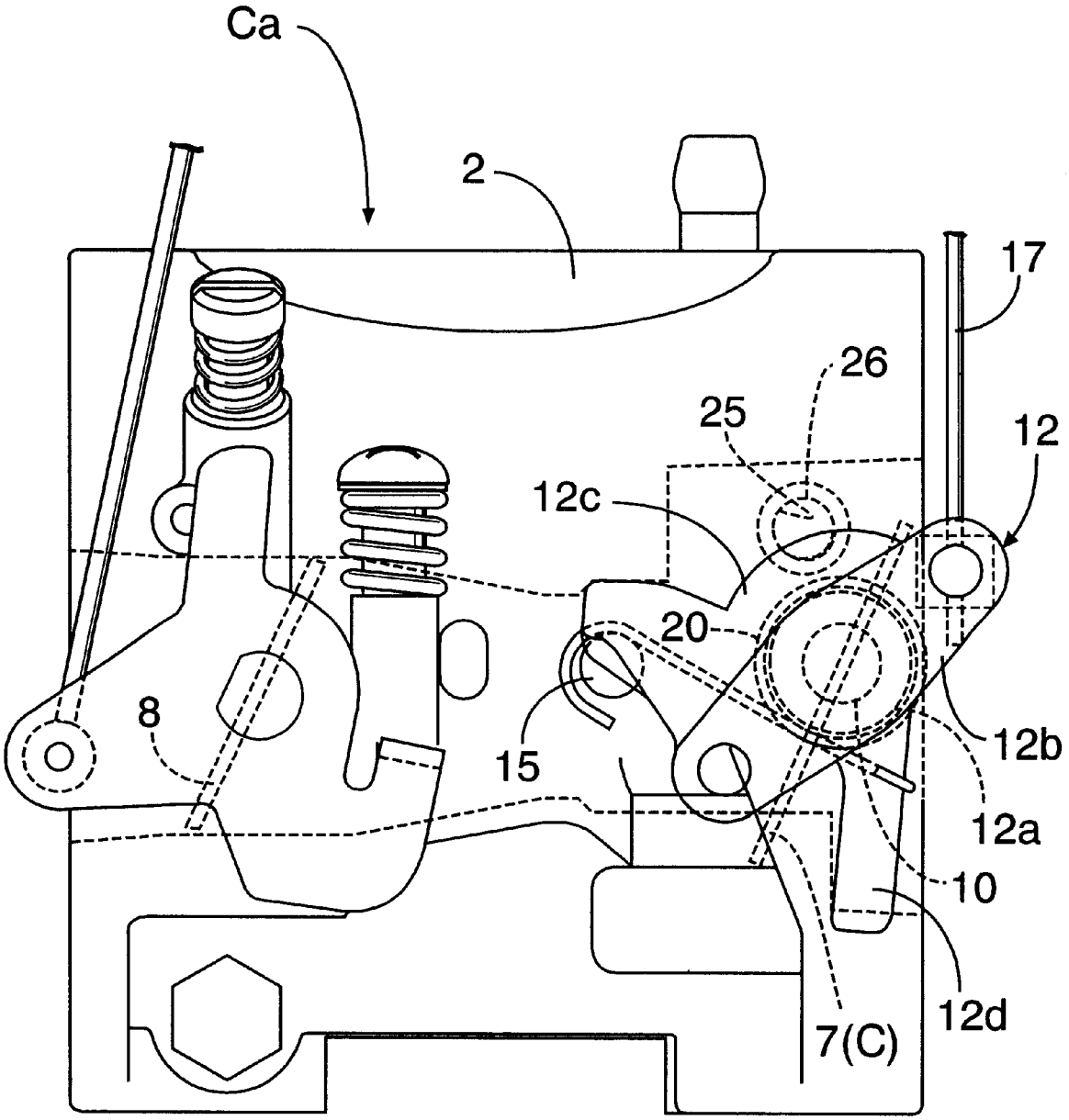
FIG. 5 is a view showing a fully closed state of a choke valve and similar to FIG. 2 for explaining the operation of the choke valve.
Figure 6:
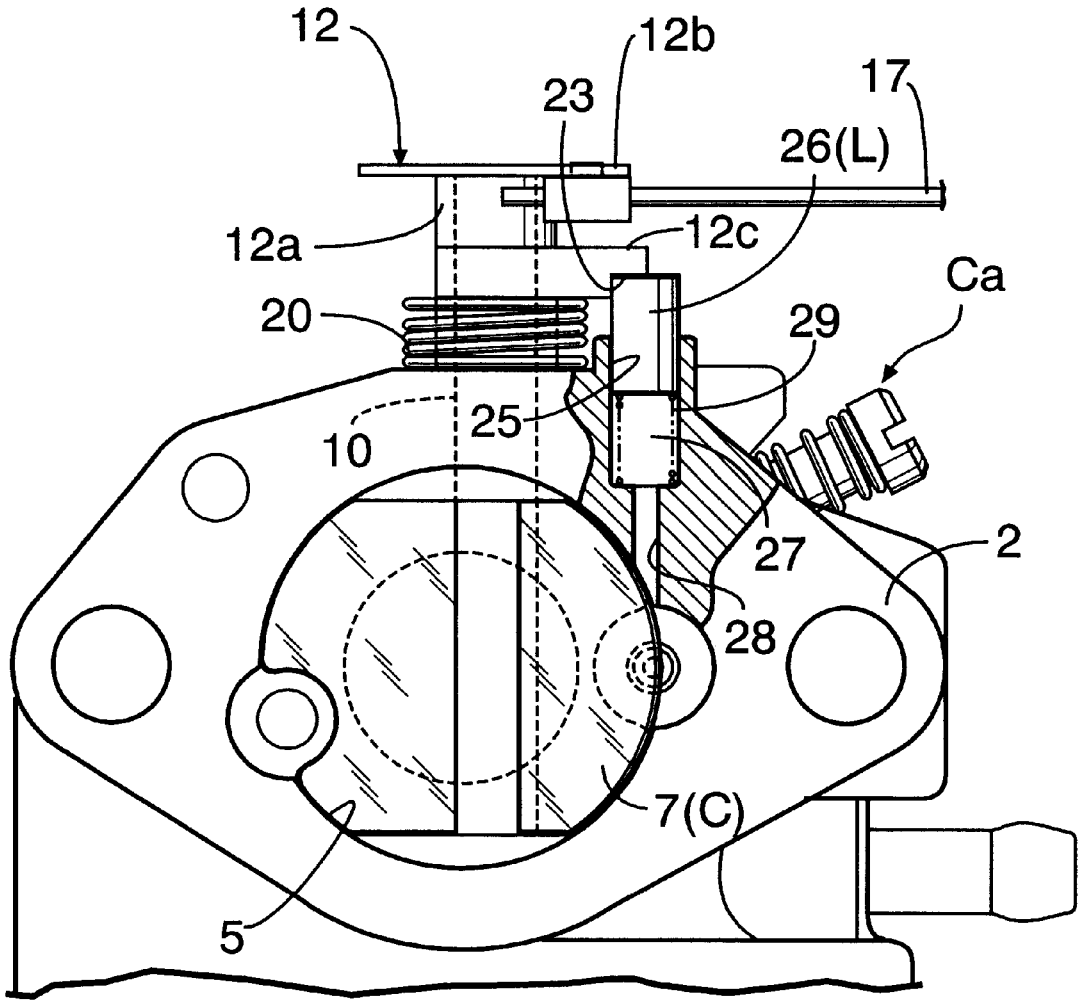
FIG. 6 is a view showing a fully opened state of the choke valve and similar to FIG. 3 for explaining the operation of the choke valve.

Prior to the starting of the engine, the operating rod 17 is pulled by the operating knob 16, whereby the choke lever 12 is moved in a counterclockwise direction, as viewed in FIG. 2, against the biasing force of the opening spring 20 to bring the choke valve 7 into a fully closed state. When the choke lever 12 reaches the fully closed position C of the choke valve 7, as shown in FIGS. 5 and 6, the locking recess 23 in the control collar 12*c* reaches a position immediately above the locking piston 26. Therefore, the locking piston 26 is moved upwards by the biasing force of the locking spring 29 to come into engagement with the locking recess 23 to occupy the locked position L, thereby restraining the choke lever 12 at the locked position L. Thus, even if an operating force is released from the operating knob 16, the fully closed state of the choke valve 7 is maintained.

Consequently, when the engine is cranked, a relatively large negative pressure acts on the main nozzle 6 to urge the injection of fuel from the main nozzle 6. Therefore, a rich air-fuel mixture suitable for starting the engine is produced in the intake passage 5, and the rich air-fuel mixture is drawn into the engine to immediately start the engine.

When the engine is started, an intake negative pressure in the engine is transmitted from the intake port 4 to the intake passage 5 in the carburetor Ca, and inhibited by the choke valve 7 in the fully closed state from being released to the atmospheric air, whereby an intake negative pressure equal to or greater than a predetermined value is introduced via the negative pressure introducing bore 28 into the negative pressure operating chamber 27. Therefore, the locking piston 26 receiving the negative pressure on its pressure-receiving face is pulled toward the lower unlocked position U against the biasing force of the locking spring 29. As a result, the locking piston 26 is disengaged from the locking recess in the control collar 12*c* to release the choke lever 12. Thus, the choke lever 12 can be automatically moved to the fully opened position O shown in FIGS. 2 and 3 by the biasing force of the opening spring 20 to bring the choke valve 7 into a fully opened state. In association with this procedure, the operating knob 16 can also be returned to an original non-operated position.

When the intake negative pressure in the negative pressure operating chamber 27 is decreased by opening the choke valve 7, the locking piston 26 is about to be advanced toward the locked position L by the biasing force of the locking spring 29. However, the lower surface 21, i.e., the sliding surface 21 of the control collar 12*c* of the choke lever 12 already moved in the direction to open the choke valve 7 receives the upper end of the locking piston 26, and inhibits the advancing of the locking piston 26 toward the locked position L. Moreover, the lower surface 21 of the control collar 12*c* is slidable on the locking piston 26, so that movement of the choke lever 12 to the fully opened position O is never inhibited by the locking piston 26.

In this manner, the choke valve 7 is fully opened, whereby an air-fuel mixture having a normal concentration is produced in the intake passage 5, and the amount of air-fuel mixture supplied to the engine is controlled depending on the opening degree of the throttle valve 8.

In the choke valve device according to the present invention designed so that the locking piston 26 adapted to restrain the choke lever 12 in the fully closed position C of the choke valve 7 is operated to the unlocked position U by the intake negative pressure in the engine, as described above, the number of parts is extremely small and the structure is simple, as compared with the conventional choke valve device using the diaphragm device. Therefore, the choke valve device according to the present invention can be provided at a lower cost. In addition, in an opened position of the choke lever 12 other than the fully closed position C of the choke valve 7, the slipping-off of the locking piston 26 is prevented by the lower surface 21, i.e., the sliding surface 21 of the control collar 12*c*. Therefore, it is unnecessary to mount a member exclusive for preventing the slipping-off of the locking piston 26.

Although an embodiment of the present invention has been described in detail, it will be understood that the present invention is not limited to the above-described embodiment, and various modifications in design may be made without departing from the spirit and scope of the invention defined in the claims. For example, the number of the intake passage in the carburetor is not limited to one as in the embodiment and can be selected freely in accordance with the number of cylinders in a multi-cylinder engine.

What is claimed is:

1. A choke valve device in a carburetor including a carburetor body having an intake passage, comprising:

a choke valve opening and closing said intake passage at a location upstream of said intake passage;

a valve stem attached to said choke valve and rotatably carried in said intake passage;

a spring biasing said choke valve in an opening direction;

a negative pressure operating chamber provided in said carburetor body to communicate with said intake passage at a location downstream from said choke valve;

a locking piston mounted in said carburetor body with its pressure-receiving face facing said negative pressure operating chamber and adapted to be advanced and retracted between a locked position (L) and an unlocked position (U), said locking piston being biased toward the locked position (L) by a locking spring; and a choke lever secured to said valve stem provided with a locking portion which restrains said choke lever at the fully closed position in such a manner that said locking portion engages with said locking piston advanced to said locked position (L) by a biasing force of said locking spring when said choke lever has been moved to a fully closed position (C) of said choke valve, wherein said locking piston is retracted to said unlocked position (L) and is disengaged from said locking portion when an intake negative pressure equal to or greater than a predetermined value is introduced into said negative pressure operating chamber upon starting the engine.

2. The choke valve device in a carburetor according to claim 1, wherein said choke lever has a sliding surface which slidably receives an outer end face of said locking piston and inhibits the advancing of said locking piston toward the locked position (L) of said locking piston when said choke valve is in a position other than the fully closed position (C).

* * * * *